US006266966B1

(12) United States Patent
Fernandez et al.

(10) Patent No.: US 6,266,966 B1
(45) Date of Patent: Jul. 31, 2001

(54) COOLING SYSTEM FOR COMPARTMENTS MAINTAINING THE RELATIVE HUMIDITY OF REFRIGERATED PRODUCTS

(75) Inventors: Alfredo Diaz Fernandez; Cesar Gutierrez Perez Reguera; Luis Humberto Uriostegui Vazquez; Gerardo Gonzalez Camacho; Bernardo Vazquez Mellado Esqueda; Jose Rafael Castro Gutierrez, all of Querétaro (MX)

(73) Assignee: Mabe Mexico S. de R.L. de C.V., Queretaro Qro (MX)

( * ) Notice: Subject to any disclaimer, the term of this patent is extended or adjusted under 35 U.S.C. 154(b) by 0 days.

(21) Appl. No.: 09/200,449

(22) Filed: Nov. 27, 1998

(30) Foreign Application Priority Data

Jun. 4, 1998 (MX) ..... 984438

(51) Int. Cl.[7] ..... F25D 17/08
(52) U.S. Cl. ..... 62/186; 62/441

(58) Field of Search ..... 62/187, 186, 180, 62/419, 441

(56) References Cited

U.S. PATENT DOCUMENTS 2,526,063 * 10/1950 Booth ..... 62/186
2,866,323 * 12/1958 Candor ..... 62/187
3,633,375 * 1/1972 McLean ..... 62/186 X

* cited by examiner

*Primary Examiner*—Harry B. Tanner
(74) *Attorney, Agent, or Firm*—Carmen Pili Curtis

(57) ABSTRACT

A cooling system for compartments that keep the relative humidity of products in refrigeration, characterized because it has a contact duct by means of a heat transfer plate, applied to the functioning of a two-door and two-compartment refrigerator with independent temperature regulation between the two compartments, refrigerator and freezer. The compartments are separated and the air is not mixed, thus the refrigerator compartment dehydrates less the food contained therein.

22 Claims, 3 Drawing Sheets

Figure 1A:
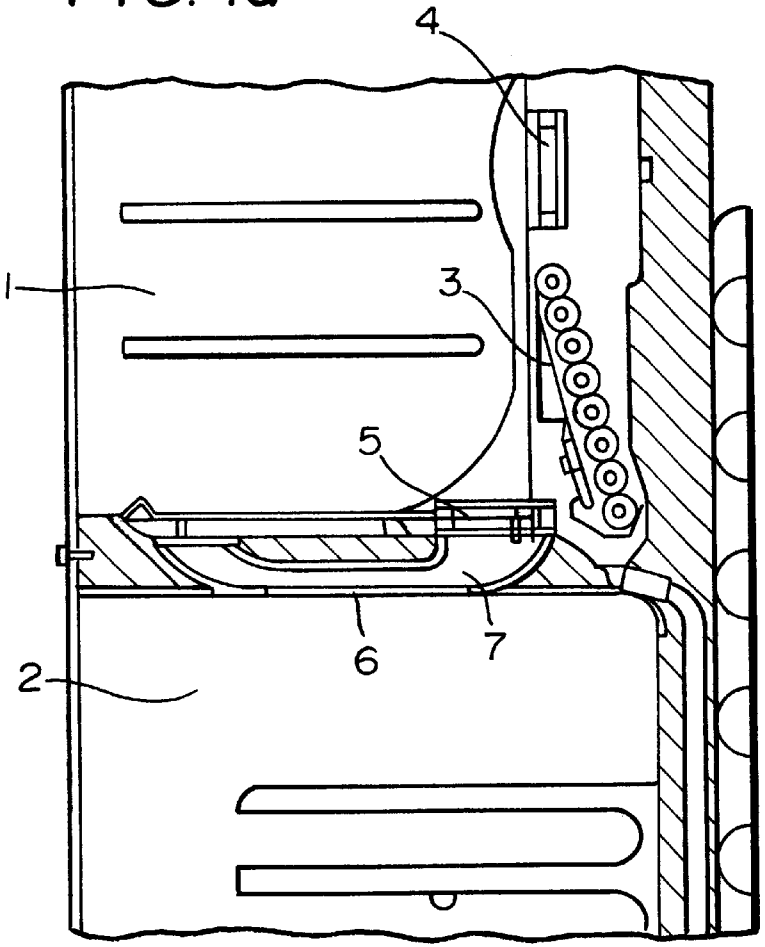

COOLING SYSTEM FOR COMPARTMENTS MAINTAINING THE RELATIVE HUMIDITY OF REFRIGERATED PRODUCTS

BACKGROUND OF THE INVENTION

Different cooling systems are known in the art of the refrigeration. Thus, for example, it is known that the air temperature within a refrigerator must be at 3° C., which means low levels of the air humidity. In the case of a refrigerator without frost formation (No-Frost) the air circulates from the refrigerator compartment to the evaporator and returns to the refrigerator compartment. The effect of this air circulation, upon passing through the evaporator, which is normally at a temperature well below 0° C., is that it captures the air humidity condensating it in the evaporator and leaves the air returning to the refrigerator very dry. This dry air dehydrates the food contained in the refrigerator and thus a refrigerator that does not dehydrate food must have a cooling system in which the air does not pass to the evaporator in order to avoid getting to temperatures below 0° C. A technique to reach this objective is to manufacture a refrigerator with separated compartments and to equip the freezer with an evaporator and the refrigerator with a cold plate. This solution to the problem of drying food is correct but it has the drawback of being highly complex and costly.

Among other known systems, there is the one of the condensation in the frame of the refrigerator door such as the one described in U.S. Pat. No. 4,192,149, in which a refrigerator cabinet is claimed which includes a chamber divided by a mullion between the freezer and the fresh food compartment and each chamber has a front part opened towards the door frame that prevents the condensation of the system.

In U.S. Pat. No. 4,250,719, the assembly of a panel in the refrigerator compartment with controlled humidity is described, said assembly includes a storage container with an open upper part and a stationary lid inside the refrigerator to receive the container, and a control mechanism. Through this arrangement, the user can move said mechanism to increase or diminish the amount of ventilation and thus control the humidity inside the container. As can be observed, said control is manual.

In U.S. Pat. No. 4,729,613, a modification of the previous patent is described, in which an assembly of container in two removable sections for fresh food within a rigid unitary frame is claimed.

The applicant has developed a new cooling system through a contact duct which is applied to the functioning of a two-door and two-compartment refrigerator with independent temperature regulation between the two compartments, refrigerator and freezer. The compartments are separated and the air is not mixed. Thus, the refrigerator compartment dehydrates less the food contained in it.

There is also the air circulation system without mixing the air between the two chambers, as would be the case of the two evaporators used on the European market. Said system of two evaporators is the one which is nearest to the objective of not dehydrating food in the refrigerator compartment, but it is a more expensive system.

Hereinafter, the invention will be described with reference to FIGS. 1 to 3.

DESCRIPTION OF THE INVENTION

Figure 1:
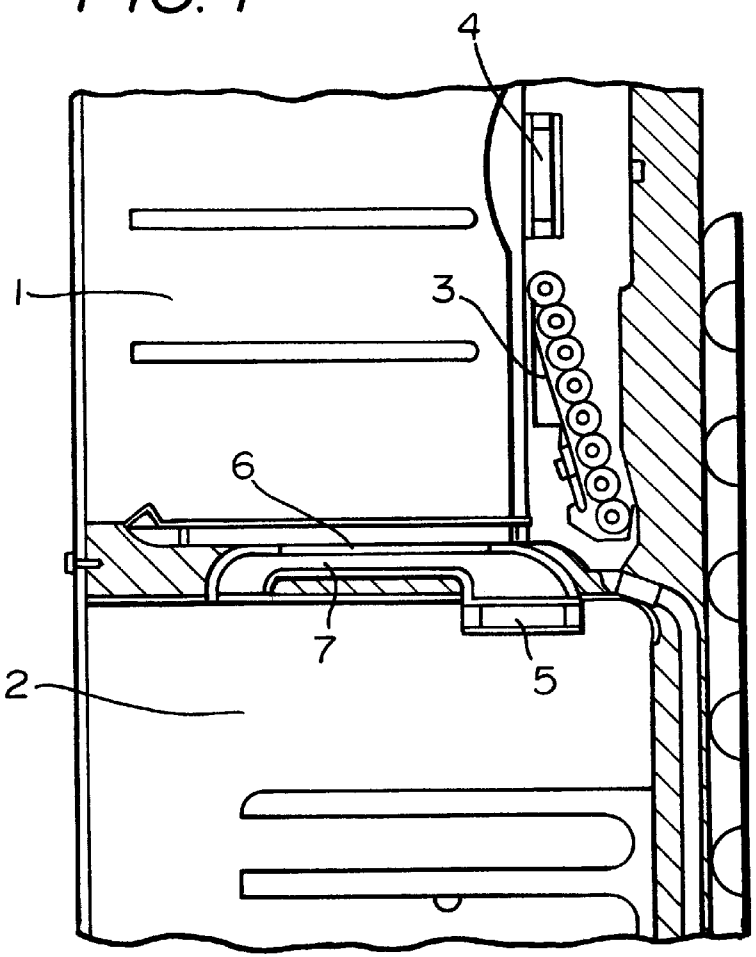

The present invention relates to a new cooling system according to the drawings wherein:

FIG. 1 corresponds to a view of a refrigerator cabin in which a two-door and two-compartment refrigerator is shown with independent regulation.

FIG. 1*a* corresponds to an embodiment of the heat transfer plate of FIG. 1.

Figure 2:
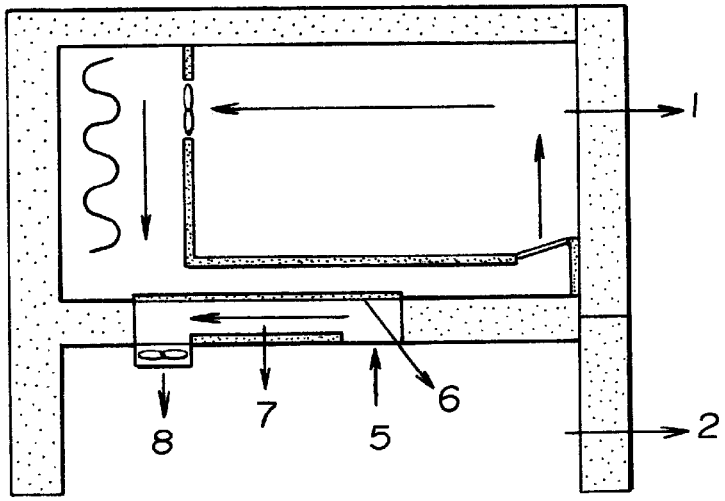

FIG. 2 corresponds to a top view in which the pipe system between the freezer compartment and the refrigerator compartment is shown.

Figure 3:
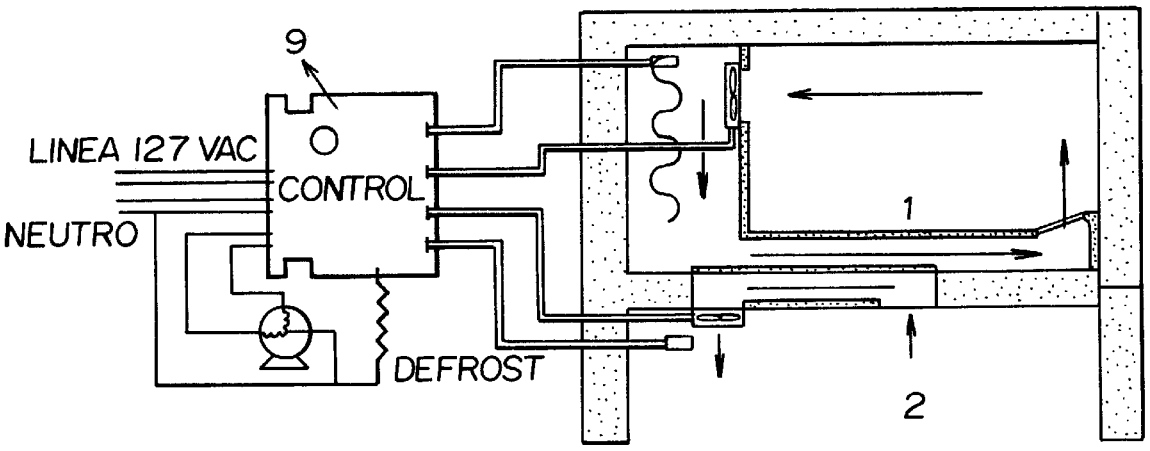

FIG. 3 corresponds to a block diagram of the duct system control.

Figure 4:
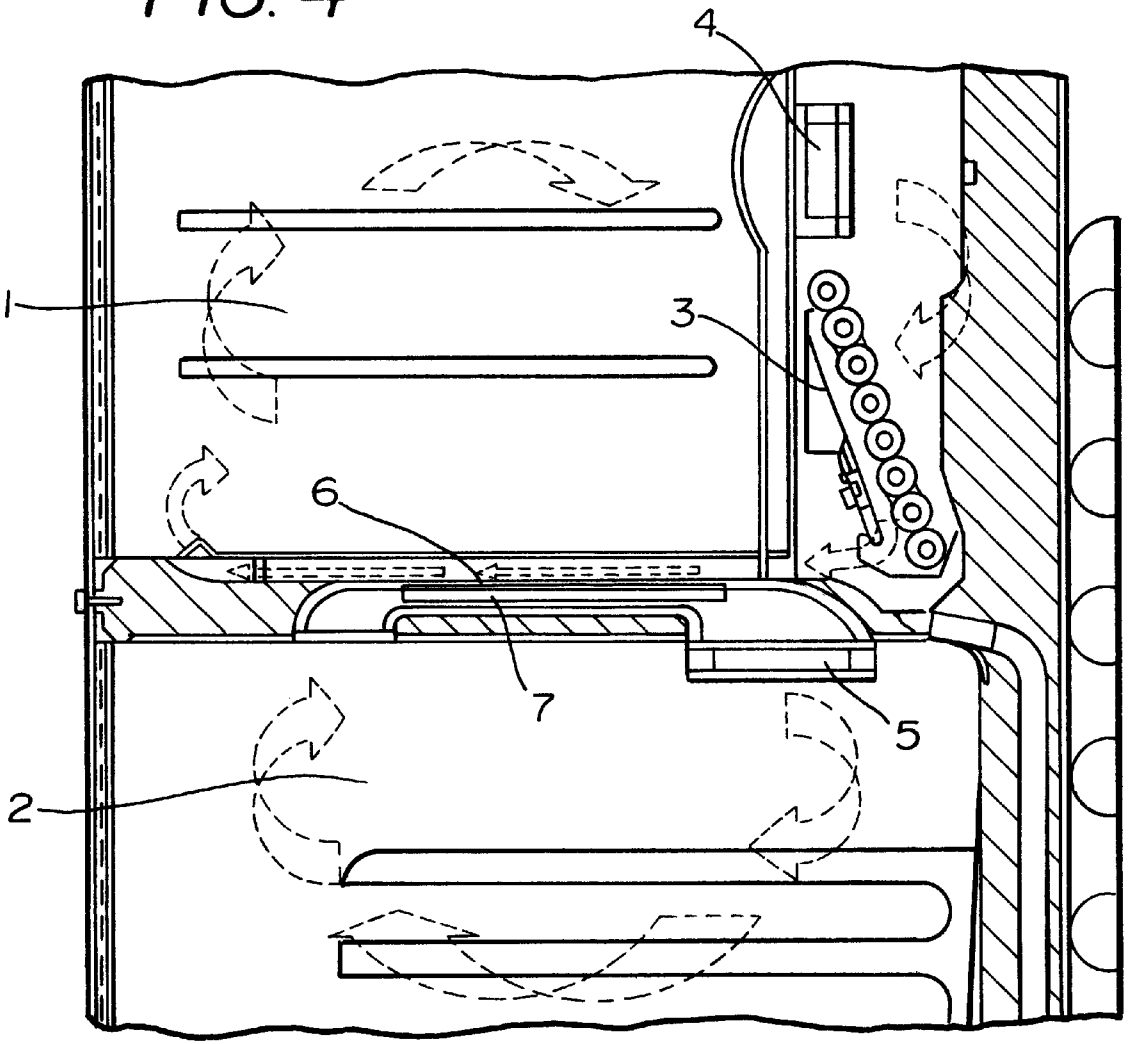

FIG. 4 corresponds to the duct system and housing.

According to what has previously been said, the invention relates to refrigerators that include a combination of a refrigerator compartment for fresh food 2, FIGS. 1 to 3, and a freezer compartment for freezing food 1, FIGS. 1 to 3. Both compartments are cooled by the operation of a conventional system including: compressor, capillary condenser and one or two evaporators 3, FIGS. 1 and 1*a*. Both compartments are cooled by means of the circulation of air through evaporator 3 and returning said air to both compartments.

With regard to the air circulation, one unique impeller fan 4, FIGS. 1 and 1*a*, dividing by means of ducts the air flow to each compartment can be used, or two fan can be available, one for each compartment, 4, 5, FIGS. 1, 1*a*. A fan for the freezer, and a flow regulating butterfly, usually known as damper, for the refrigerator can also be used.

In order to obtain the above mentioned cooling system, the applicant implemented a new cooling concept of the refrigerator compartment. This new concept was given the name of Duct System 7. The functioning principle of the Duct consists in passing the air from the refrigerator 2 through a Duct 7 cooled by conduction by means of a heat transfer plate 6 through the Duct wall, without mixing it with the freezer air 1. In order to reach the objective of cooling the refrigerator 2, Duct 7 is set to high flow. The amount of heat removed by this air flow from the refrigerator is equal to:

$$Q=KM\,(T_2-T_1)$$

where $T_2-T_1$ is the air temperature differential (entrance temperature minus exit temperature), K is a constant and M is the air mass flow through the Duct. Thus, if the mass flow is large (the larger, the better), the temperature differential is low. If the refrigerator temperature is 3° C., a low temperature differential will permit that the cold air 8 exiting the Duct could be at temperatures around 0° C., but not below zero. This working mode helps keep food moisture because it does not present air cold enough to freeze the humidity of the air in the refrigerator compartment.

Contrary to a no-frost refrigerator, the M component is increased in the duct and thus the temperature differential diminishes. The result is the removal of the same amount of heat from the refrigerator but at not so cold air temperatures.

Control Description

The control 9 of the refrigerator with the Duct System, FIG. 3, is the following. It has two relays: one that controls the compressor and one that handles the thawing resistance. It has two temperature sensors, one for each compartment: refrigerator 2, FIG. 1, and freezer 1, FIG. 1. It also has a 12 V direct current voltage source for two fans, 4 and 5, FIG. 1, one located in the freezer and the other in the Duct 7.

The temperature regulation of the freezer compartment is ensured by a sensor, located at the entrance of the evaporator 3, FIG. 1. The control turns on the compressor upon sensing a temperature above the starting temperature −15° C., and turns off the compressor upon sensing a temperature below the cutoff temperature, −25° C. The same sensor is used to end the thawing period upon reaching a temperature of 5° C.

The temperature regulation of the refrigerator compartment is used to operate a fan in the Duct. Said fan switches on when it reaches a temperature above the regulation temperature, about 3.5° C., and switches off when the temperature goes below the regulation temperature, 2.5° C.

This very small differential between the switch-on temperature and the switch-off temperature permits a very precise regulation of the temperature within the refrigerator, which is beneficial for food conservation.

Finally, the design or setting up of the Duct system 7 is not a critical aspect, i.e., it is functionally operative in all the positions and sizes of the duct shown in FIG. 1 and FIG. 1*a*.

According to the functioning, hereinbelow some embodiments of the invention are described:

Duct I

It consists of a Duct 7 made of aluminum sheet on all the floor 6 of the freezer, with air entrance through two about 2-inch diameter holes, near the door. The air exit is through the bottom of the floor with a fan 5 functioning as extractor and in the end near the evaporator 3. In this option, the following could be observed:

The faster the speed of the fan in the Duct, the higher the heat transfer is. The addition of wings or fins 8 to the aluminum sheet 6 for the Duct die increased heat transfer. In the Duct, no ice was created since the air temperature inside the Duct never reaches a level below 0° C. because the air passes very quickly and only cools a little. This was observed even after 36 hours of compressor working time.

Duct II

It consists of a Duct made on a sheet that separates the evaporator from the freezer. In this case, the air entrance to the duct is through two 2-inch diameter holes located at the sides and bottom of the upper part of the refrigerator. The air exit is located in the central part and the air is extracted by means of a fan. This option offered the following information:

The nearness of the Duct with regard to the evaporator which is the lowest temperature zone allows to transfer easily a sufficient amount of cold to the refrigerator, the air that exits the Duct reaches temperatures slightly above zero. This is improved diminishing the Duct size. The vertical form of the Duct allows a natural cold air flow towards the refrigerator, even without operating the fan, because of the chimney effect it generates.

Even though no ice is formed in the Duct because temperatures are above 0° C. in the air that circulates through it, the nearness of the duct with regard to the Defrost resistance of the freezer also allows the Duct defrosting. Said version permits a very fast lowering of the refrigerator compartment.

Duct III

This version of the duct consisted in reducing the duct area to a part of the floor. Only the area necessary to pass the two lateral holes as air entrance to the Duct and an exit hole in the center, all of them in the back p art of the refrigerator, was left. The duct is left at the bottom of the refrigerator because of the nearness of the evaporator which is the coldest zone in the freezer and most remote from the freezer atmosphere. Basically it is the same as Duct 1, but with only 30% of the area and being remote from the freezer atmosphere.

Duct II lowers the refrigerator temperature more quickly but the air flow temperatures are very low, even below zero. Duct I does not diminish the refrigerator temperature as quickly but the air flows in the Duct at temperatures which are not so low, about zero but not below 0° C., which means that it has a lower drying effect on food.

In the case of Duct I a theoretical computation of heat transmission through an aluminum sheet was made and it was discovered that with a 0.5 square foot area 100 BTU could be extracted from the refrigerator per hour, taking into account an air flow of 35 cubic feet per minute and an average temperature in the freezer of −15° C. Based on the previous calculation, a one square foot Duct should offer an excess cold capacity for the refrigerator compartment. A Duct design that increases the heat transfer effective area, without increasing the floor area occupied by the Duct, would be a corrugated sheet. With regard to Duct II, because it is nearer the evaporator, it is considered that a 0.5 square foot area is enough. This is the case because the temperatures on the side of the evaporator are lower and because the heat transfer is carried out on both sides.

The Duct has near zero temperatures, which means hot temperatures compared to the freezer temperatures. Because of the fact that having the duct near the freezer, as is the case of options I and II, produces an increase of the freezer average temperatures, it is better to have a duct remote from the freezer. A position that would fulfill what has previously been indicated is the location of the duct behind the evaporator because this position has two important advantages: it is near the cold and far from the freezer. However, a duct near the evaporator also presents the problem of producing lower temperatures, similar to what happens in the case of the duct in the vertical position. I is thus defined that the best option for the position of the duct is on the floor, limited to half the floor space and near the evaporator. Another possible alternative would be to position the Duct behind the evaporator with a Duct smaller than the one used for Duct II.

COMPARATIVE TABLE FOR DUCT SYSTEM

| | DUCT I | DUCT II | DUCT III |
|---|---|---|---|
| Cold Capacity Refrigerator | Medium | High | Low |
| Air Temperature in the Duct | About 3° C. | Below 0° C. | About 3° C. |
| Lowering Temperature Time | Medium | Fast | Slow |
| Cold Capacity Freezer | Good | Good | Better |
| Construction Ease | Very simple | Simpler | Simple |
| Defrost | Not required | Uses the same resistance | Not required |
| Ice formation in the Duct | No ice formation | Slight | No ice formation |

Based on the above comparative table it can be seen that a Duct on the floor, limited to the back part of the freezer and near the evaporator and, if necessary, with a corrugated sheet with ribs or fins on both size is the best possible option that would permit not to dry food in the refrigerator compartment.

From what has just been said, the conclusion is that the present invention shows the practicability of using a duct as a way of removing heat from the refrigerator compartment, without there being a communication between the air of the refrigerator compartment and the air of the freezer compartment. The cold source is the compressor-condenser-capillary-evaporator refrigeration system. In the case of the freezer, the temperature regulator element is the compressor operation. In the of the refrigerator, the temperature regulator element is the Duct fan. The regulation mode between both compartment is independent.

The Duct system is a solution that is very economical because it is simple and it is a solution that competes against the European system of cold plate in the refrigerator compartment, system which is more expensive.

It is thus believed that the operation and construction of the present invention will be apparent from the foregoing description. While the method, apparatus and system shown and described have been characterized as being preferred, it will be readily apparent that various changes and modifications could be made therein without departing from the scope of the invention as defined in the following claims.

What is claimed is:

1. A cooling system for a refrigerator having a refrigerator compartment with side walls, a ceiling and a floor, a freezer compartment with side walls, a ceiling and a floor, the compartments having independent temperature regulation devices and doors, the freezer compartment having a cooling system including a compressor, a capillary condenser, and an evaporator for cooling air in contact therewith, comprising: a high air mass flow ducting system comprising a duct on each compartment; said duct ride of a temperature conducting material having a metallic heat transfer plate area located between the refrigerator and the freezer compartment, the ducting system functionally operative in different locations between the refrigerator compartment and freezer compartment, allowing passage of air from the refrigerator compartment through the heat transfer plate, the air from the refrigerator compartment not mixing with air circulating through the freezer compartment but cooled by the same heat transfer plate which is also in contact with the air circulating through the freezer compartment and exiting the high air mass flow ducting system at the refrigerator compartment at a temperature of 0° C. or above, to maintain air humidity in the refrigerator compartment; said ducting system separating air passage between the refrigerator compartment and the freezer compartment; and a means for allowing the high air mass flow through the duct in the refrigerator compartment with a small temperature differential.

2. The cooling system according to claim 1 further comprising at least one additional duct system for conduction cooling and at least one impeller fan for the duct system.

3. The cooling system according to claim 2 further comprising a refrigerator control electronic system.

4. The cooling system according to claim 3, wherein the refrigerator electronic control system comprises two relays to operate the compressor; and one to operate the thawing resistance.

5. The cooling system according to claim 3 wherein the refrigerator control system comprises at least one temperature sensor for each compartment.

6. The cooling system according to claim 4 wherein the refrigerator control system further comprises a 12 V direct current voltage source which operates the freezer and duct fans.

7. The cooling system according to claim 1 wherein the heat transfer plate and ducts are made of aluminum.

8. The cooling system according to claim 1 wherein the heat transfer plate is corrugated.

9. The cooling system according to claim 1 wherein the heat transfer plate has fins to increase heat transfer.

10. The cooling system according to claim 1 wherein the means for allowing high air mass flow uses a fan.

11. The cooling system according to claim 10 wherein the fan in the refrigerator compartment switches on when a temperature of about 3.5° C. is reached and switches off when a temperature of below 2.5° C. is reached in the refrigerator compartment.

12. The cooling system according to claim 1 wherein the amount of heat Q removed by air flow is according to the equation:

$$Q=KM(T_2-T_1)$$

wherein

K is constant;

M is air mass flow;

$T_2$ is entrance temperature;

$T_1$ is exit temperature.

13. The cooling system according to claim 1 wherein the means for allowing high air mass flow uses a fan for the freezer compartment and a damper for the refrigerator compartment.

14. The cooling system according to claim 1 wherein the ducting system is functionally operative at locations selected from the group consisting of a location having the heat transfer plate on the floor of the freezer near the evaporator, a location wherein the heat transfer plate is on the floor of the freezer compartment, limited to half of the floor area and near the evaporator, a location with the heat transfer plate behind the evaporator, a location on a rear side of the freezer compartment and transversely under the evaporator, and a location having the heat transfer sheet separating the evaporator from the freezer compartment.

15. The cooling system according to claim 14 wherein when the duct is on the heat transfer plate at the bottom part of the freezer compartment, the air enters through holes on the duct near the front of the freezer compartment and the air exits through the bottom part of the freezer.

16. The cooling system according to claim 14 wherein when the duct is on a sheet that separates the evaporator from the freezer, the air enters the duct through two holes being laterally located at the sides and bottom of the top part of refrigerator compartment and the air exits in the central part of the refrigerator compartment, the air being extracted through a fan located at the rear of the refrigerator compartment.

17. The cooling system according to claim 14 wherein when the duct is located on the rear of the freezer and transversally under the evaporator, the duct has a reduced area, the air enters through holes of the duct and the air exits through the center of the refrigerator compartment top part.

18. The cooling system according to claim 14 wherein when the heat transfer plate is behind the evaporator, the ducting system is smaller than the ducting system located on the entire floor area of the freezer near the evaporator.

19. The cooling system according to claim 14 wherein when the heat transfer plate is on the floor of the freezer near the evaporator, the heat transfer plate is only 30% of the floor area.

20. The cooling system of claim 1 wherein the heat transfer plate is made of sheet.

21. A method of refrigeration comprising the steps of:

a) providing a refrigerator comprising: a refrigerator compartment with side walls, a ceiling and a floor, a freezer compartment with side walls, a ceiling and a floor, the compartments having independent temperature regulation devices and doors, the freezer compartment having a cooling system including a compressor, a capillary condenser, and an evaporator for cooling air in contact therewith; comprising:

a high air mass flow ducting system comprising a duct on each compartment; said duct made of a temperature conducting material having a metallic heat transfer plate area located between the refrigerator and the freezer compartment, the ducting system functionally operative in different locations between the refrigerator compartment and freezer compartment, allowing passage of air from the refrigerator compartment through the heat transfer plate, the air from the refrigerator compartment not mixing with air circulating through the freezer compartment but cooled by the same heat transfer plate which is also in contact with the air circulating through the freezer compartment and exiting the high air mass flow ducting system at the refrigerator compartment at a temperature of 0° C. or above, to maintain air humidity in the refrigerator compartment;

said ducting system separating air passage between the refrigerator compartment and the freezer compartment; and a means for allowing the high air mass flow through the duct in the refrigerator compartment with a small temperature differential;

b) circulating the air through in succession, said compressor, said evaporator, said condenser and back to said compressor;

c) producing an air flow from the refrigerator compartment through the duct;

d) cooling by conduction with a heat transfer plate through the duct wall;

e) regulating the temperature in the refrigerator compartment by means of a fan in the duct which switches when the temperature reaches above 3.5° C. and switches off when it reaches below 2.5° C.; and f) regulating the temperature in the freezer by means of a sensor at the evaporator entrance which turns on the compressor upon sensing a temperature of −15° C. and turns off compressor upon sensing a temperature below −25° C.; wherein the same sensor is used for end thawing upon reaching a temperature of 5° C.

22. The method according to claim 21 wherein the duct is functionally operative at locations selected from the group consisting of a location having the heat transfer plate on the floor of the freezer near the evaporator, a location wherein the heat transfer plate is on the floor of the freezer compartment, limited to half of the floor area and near the evaporator, a location with the heat transfer plate behind the evaporator, a location on a rear side of the freezer compartment and transversely under the evaporator, and a location having the heat transfer sheet separating the evaporator from the freezer compartment.

* * * * *